US006361580B1

(12) United States Patent
Plahte et al.

(10) Patent No.: US 6,361,580 B1
(45) Date of Patent: Mar. 26, 2002

(54) METHOD FOR PRODUCTION OF ALUMINUM

(75) Inventors: Sven Plahte, Hovik; Bjorn Lillebuen, Stathelle, both of (NO); Alexander F. Diaz, Dallas, TX (US); Jack B. Howard, Winchester, MA (US); Anthony J. Modestino, Hanson, MA (US); William A. Peters, Lexington, MA (US)

(73) Assignee: Massachuetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/622,753

(22) PCT Filed: Feb. 26, 1999

(86) PCT No.: PCT/NO99/00068

§ 371 Date: Aug. 21, 2000

§ 102(e) Date: Aug. 21, 2000

(87) PCT Pub. No.: WO99/43859

PCT Pub. Date: Sep. 2, 1999

(30) Foreign Application Priority Data

Feb. 26, 1998 (NO) ..... 19980800

(51) Int. Cl.[7] ..... C22B 21/02

(52) U.S. Cl. ..... 75/10.21; 75/10.27; 75/674; 75/673

(58) Field of Search ..... 75/10.21, 10.27, 75/674, 673

(56) References Cited

U.S. PATENT DOCUMENTS

| | | | | | |
|---|---|---|---|---|---|
| 2,090,451 | A | * | 8/1937 | Kruh | 75/674 |
| 3,783,167 | A | * | 1/1974 | Tylko | 373/23 |
| 4,154,972 | A | * | 5/1979 | Tylko | 373/23 |
| 4,177,060 | A | * | 12/1979 | Tylko | 75/10.21 |
| 6,086,655 | A | * | 7/2000 | Ellingsen et al. | 75/673 |

FOREIGN PATENT DOCUMENTS

GB 2 038 880 A 1/1979

* cited by examiner

*Primary Examiner*—Melvyn Andrews
(74) *Attorney, Agent, or Firm*—George W. Neuner, Esq.; Dike, Bronstein, Roberts & Cushman, IP Group of Edwards & Angell, LLP

(57) ABSTRACT

A continuous process for the production of elemental aluminum is described. Aluminum is made from aluminum oxide and a reducing gas such as a light hydrocarbon gas or other reducing gas, for example hydrogen. In the process, a feed stream of the aluminum oxide and the reducing gas is continuously fed into a reaction zone. There the aluminum oxide and reducing gas are reacted at a temperature of about 1500° C. or greater in the reaction zone to provide a continuous product stream of reaction products, which include elemental aluminum. The product stream is continuously quenching after leaving the reaction zone, and the elemental aluminum is separated from the other reaction products.

23 Claims, 1 Drawing Sheet

METHOD FOR PRODUCTION OF ALUMINUM

Figure 1:
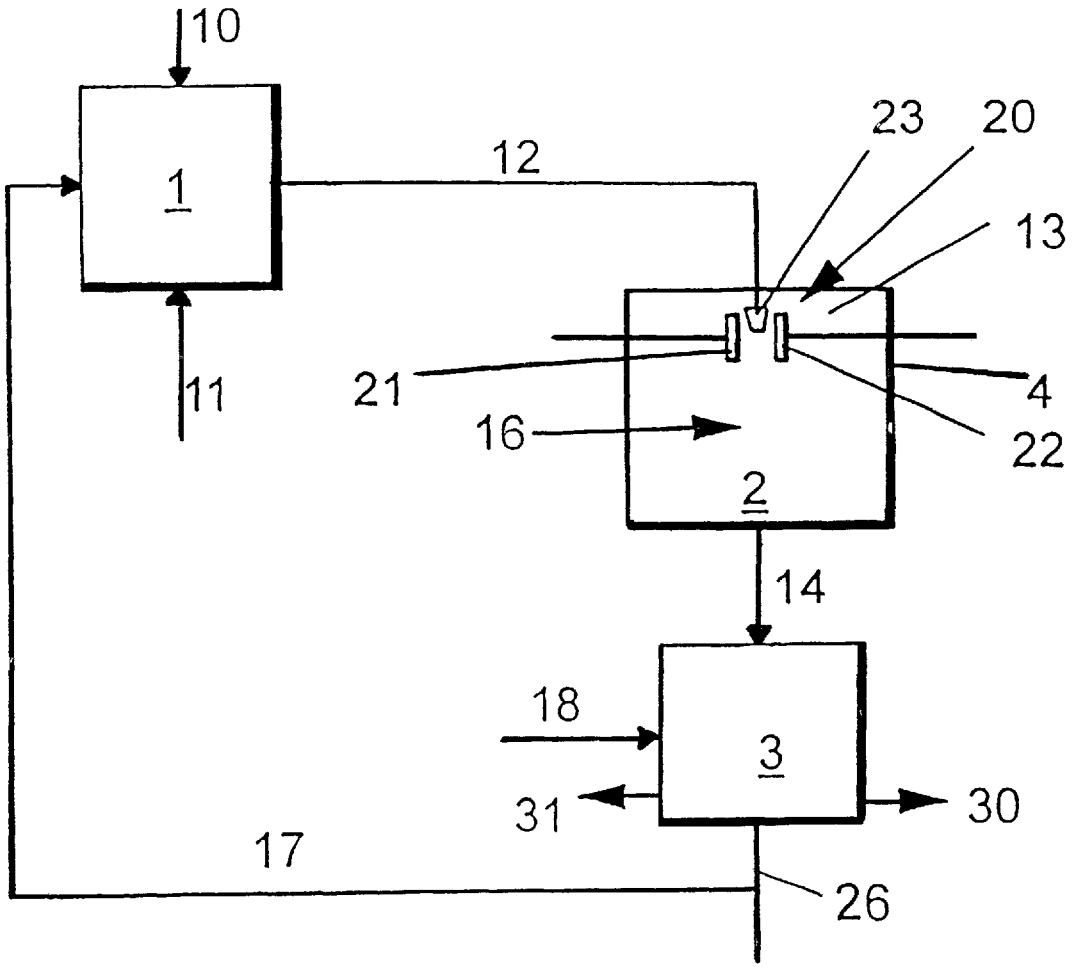

The present invention relates to a method for producing aluminium metal. More specific, the invention relates to a continuous process for the production or aluminium metal.

Aluminium metal is today almost exclusively produced by the use of Hall-Héroult cells.

U.S. Pat. No. 3,783,167 discloses an arc furnace involving the use of a circulating electrode or a plasma gun for performing various chemical reactions including the reduction and separation of ores. In one embodiment described in the patent, aluminium oxide or alumina can be introduced into the plasma, and then at a lower point in the reactor propane is introduced. The patent do not describe completely whether the process can be carried out as a continuous process, which is of great importance when processing in an industrial scale. Furthermore, the patent do neither describe what the by-products of the process are.

According to the present invention, aluminium metal can be produced in a continuous process, and the process will in addition give valuable by-products.

The potential of the method in accordance with the invention will represent a more efficient and more economical process for making aluminium metal. Further the process may be carried out at a slight overpressure with respect to the ambient pressure, and may be carried out with inexpensive feed materials of standard commercial quality.

The invention shall be further described by example and a figure where:

FIG. 1 shows a process diagram for the principles of the process

FIG. 1 shows a continuous process that prepares aluminium metal from alumina ($Al_2O_3$) and a reduction gas. The reduction gas in the presented embodiment can be a hydrocarbon gas, for instance a light hydrocarbon gas such as natural gas with a high content of methane gas ($CH_4$). In the following description of this embodiment, the term "methane gas" is applied for the reduction gas.

The feed stream of alumina 10 is led into a mixing chamber 1 where the alumina is mixed with the gas fed into the chamber through line 11. The mixing action may be generated by swirling action, or other conventional ways involving the use of means known by those skilled in the art. Such means can involve dense phase fluidised bed, a transfer line, an entrainment tube or other suitable gas-solids mixing apparatus. Preferably, the mixture is preheated in the mixing chamber at temperatures low enough that significant reaction of the starting materials will not occur. In the chamber, temperatures of 850° C. or less will be appropriate. It should be understood that the preheating may be performed by heating means in the mixing chamber, or by the preheating of the one or both individual feeds before they enter the mixing chamber.

The mixture of alumina and the methane gas is then fed to a plasma reactor chamber 2, through connection 12 and nozzle 23 that is located inside the chamber. The reaction chamber 2 is constituted by an enclosed vessel 4 having a plasma reactor 20 inside, arranged in the vicinity of the nozzle 23. The mixture enters the reactor chamber 2 in its upper region 13, where the mixture is rapidly heated to a temperature sufficiently high that aluminium, and one or more valuable gaseous co-products, such as carbon monoxide (CO) and molecular hydrogen ($H_2$) form in appreciable yields.

The reaction that takes place may be described by the following equations:

$$Al_2O_3+3CH_4=2Al+3CO+6H_2 \quad (1)$$

$$2Al_2O_3+9CH_4=Al_4C_3+6CO+18H_2 \quad (2)$$

The reaction (1) is highly endothermic, and at high temperatures, i.e. above 1500° C., the right side of the equation (1) will dominate, and followingly Al will be produced. As aluminium has a boiling point at atmospheric pressures at 2467° C., the temperature in a slightly overpressurised system should preferably be above this temperature. Further, reactions at temperatures above 1500° C. may produce aluminium and other aluminium-containing products like carbides (2).

In the reaction chamber, the mixture is preferably heated quite rapidly to a temperature sufficiently high to cause conversion of the $Al_2O_3$ to Al in the chamber 2. The temperature can be much higher than the boiling point of aluminium, especially if certain means of feed heating, such as thermal plasma is applied. Typical residence time of the reactants in the chamber is at least 0.01 seconds. The residence time will be tuned to give the best fit to the reaction temperature, the feed materials and other process parameters.

The conversion of $Al_2O_3$ to Al in the reaction chamber 2 will typically be well above 30%, depending on the process parameters.

The mixture is preferably heated by the plasma reactor 20 which involves the use of an electrical arc that is discharged between a cathode 21 and an anode 22. The arc is preferably arranged in such a manner that the mixture entering the chamber 2 through line 12, passes wholly or partly through the arc. As known to those skilled in the art, such reactors may comprise arrangements for maximising production of aluminium, the cooling of the electrodes, magnetic fields for the stabilisation or otherwise manipulation of the arc discharge (not shown). Further, the plasma reactor may commonly include a plasma generator system that consists of an arc discharge d.c. plasma torch, a high frequency oscillator, a control console and a d.c. power supply unit (not shown). An industrial scale generator have to sustain an effect of several thousand kilowatts, while the voltage may be in accordance with industrial standards.

It should be understood that other methods of heating the mixture can be appropriate within the scope of the invention. Such methods may involve transmission of heat, e.g., by radiation, convection or conduction, from the external walls of the chamber to heat the mixture. Such heating can be sustained by electrical heaters or by heat exchange with a hot fluid, or by thermal radiation from the inner side of the enclosed vessel 4. The heat required may wholly or in part be provided by burning off one or more of the by-products in the process, possibly in combination with other products.

The products and possible unconverted feed may be partially cooled in a lower part of the reaction chamber 2. The cooling may be performed rapidly, to reduce loss of aiuminium metal. The cooling is preferably implemented in a manner that assists the subsequent processing of the converted aluminium. It should be understood that the aluminium may be recovered from a succeeding separator chamber in liquid state as the temperature to which the effluent gas and reaction products is lowered, is above 660° C. The aluminium may be recovered as a solid material, whereby the temperature is lowered below its melting point, i.e. about 660° C. In a third mode, the aluminium may be recovered in a vapour state, i.e. the temperature to which the products are cooled is no lower than 2467° C.

The cooling of the products in the reaction chamber may be carried out in various ways, known to those skilled in the art. Such ways include, for instance extraction of heat from the vicinity of the products, that will say from appropriate portions of the chamber 3, by heat transfer through the walls of the reaction chamber 2, or by the introduction of appropriate coolants, where the heat is transferred from the reaction products to the coolants.

Such coolants or quenching agents can be introduced into the reaction chamber by a feed line connected with an injector 16 centrally placed in the mid- or lower part of the chamber 2. The injector is preferably arranged in such a manner that the process stream is diluted evenly by the quenching agent, whereby an even temperature drop in the process stream may be achieved.

Typically, such coolants or quenching agents may include inert solid particles (silica or ceramic particles), vapours and gases, or mixtures thereof. Liquid droplets, such as liquid aluminium may also be applied. Such agents should be able to undergo endothermic changes of state by physical or chemical means at the temperatures appropriate for cooling aluminium or other products of the process. Further the coolants/quenching agents should have such properties that they can easily be separated from aluminium.

In the separation chamber 3 the elemental aluminium is separated from the product stream. The aluminium can then be transferred to further purification, storage or utilisation in a particular process. In the Figure the separation chamber is showed as physically separated from the reaction chamber 2. However, it should be understood that these two chambers could be included in one processing unit when appropriate.

In the separation chamber, elemental aluminium in solid, liquid or vapour state can be separated from other reaction products and possible unreacted feed. In the chamber, a number of separations can be employed. For instance, if aluminium is in the vapour state when entering the chamber, first various solids are removed and then aluminium can be removed from the vapour phase, to separate it from gaseous products such as CO, $H_2$ and from possible unconverted feed materials. The unconverted materials can be removed from chamber 3 through connection 26 and recycled to the mixing chamber through line 17. Aluminium at different states (e.g., solid, vapour, liquid or mixed) may for instance be removed through outlets as denoted by 31, 32.

The separation may be performed by conventional techniques that involve the use of cyclones, centrifuges, staged cascade impactors etc. Separation may also be performed by the introduction of aluminium recovery agents into the separation chamber, for instance through line 18. These agents may be solids, liquids, or vapours of particular chemical compositions and of suitable physical sizes/amounts. Further, it would be recognised by those skilled in the art that the separation can be sustained in different ways, such as condensation of aluminium vapour as liquid or solid, solidification of liquid aluminium, physisorption, chemisorption or other means of separating the products in the chamber.

The by-products is represented in a highly valuable gas-mixture that can be used as fuel or basic constituents for chemical industry, such as in the production of ammonia and methanol. The process thus may be integrated in processes for the production of ammonia and methanol.

It should be understood that other light hydrocarbon gases or gas-mixtures can be applied. Other gases such as ethane, propane and butane or mixtures of these may be applied, which will be more in line with the basic constituents for the production of ammonia/methanol.

Further reduction gases can be suggested in the process as well, such as hydrogen ($H_2$) or carbonmonoxide (CO).

The overall reactions using hydrogen or carbonmonoxide will be as follows (3), (4) respectively:

$$2Al_2O_3+6H_2=4Al+6H_2O \quad (3)$$

$$Al_2O_3+3CO=2Al+3CO_2 \quad (4)$$

The alumina used in the process, may preferably be of an industrial grade, that is with particle size 0.01–0,15 millimetres. Such particle sizes will represent a quite large surface of the material, which will be of importance with respect to the reaction speed. A large surface of the material will give a high reaction rate.

The pressure in the process chambers, such as mixing-, reaction- and separationchambers are typically maintained at a pressure above the prevailing atmospheric pressure to avoid entrance of atmospheric air into the process equipment. Individually, the pressures may differ between these chambers mutually.

In the example described above, the alumina and reduction gas are mixed in a separate mixing chamber before entering the plasma reaction zone. However, in an embodiment (not shown) the alumina and the reduction gas may be fed to the reaction zone by separate inlets, while being mixed immediately before or in the reaction zone.

The alumina and the reduction gas may be mixed immediately before entering the plasma reaction zone, for instance by means of a common nozzle with connectors for both alumina and gas, or by means of two co-operating nozzles, one for alumina and the other for gas, generating a swirling/mixing action (not shown).

It should be understood that the process equipment is described here on a rather conceptual basis. However, on the background of the description as set forth here, those skilled in the art should be capable of arranging the sensors, manometers, controllers etc. necessary to run the process and to tune in vital process parameters.

What is claimed is:

1. A continuous process for the production of elemental aluminum from feed materials consisting essentially of aluminum oxide and a light hydrocarbon gas, the process comprising: continuously feeding a feed stream comprising the aluminum oxide and the light hydrocarbon gas directly into a high temperature reaction zone, reacting the aluminum oxide and gas at a temperature of about 1500° C. or greater in the reaction zone to provide a continuous product stream comprising reaction products including elemental aluminum, continuously quenching the product stream, and separating the elemental aluminum from other reaction products.

2. The process of claim 1, wherein the aluminum oxide and the light hydrocarbon gas are mixed before entering the reaction zone.

3. The process of claim 1, wherein one or both of the aluminum oxide and light hydrocarbon gas are preheated before entering the reaction zone.

4. The process of claim 3, wherein the preheat temperature is 850° C.

5. The process of claim 1, wherein the aluminum oxide and light hydrocarbon gas are rapidly heated to the temperature of about 1500° C. or greater.

6. The process of claim 5, wherein the aluminum oxide and light hydrocarbon gas are heated by a plasma arc discharge.

7. The process of claim 1, wherein the quenching step includes rapidly cooling the product stream to a temperature of about 1500° C. or less.

8. The process of claim 1, wherein the light hydrocarbon gas comprises methane as the main component.

9. The process of claim 1, wherein the aluminum is separated as a vapor, a liquid or a solid, or as a mixture of physical states.

10. The process of claim 1, wherein the aluminum oxide is an industrial grade material having a particle size of 0.01 to 0.15 millimeters.

11. The process of claim 1, wherein the reaction products include CO, $H_2$, or a mixture of the same.

12. A continuous process for the production of elemental aluminum from feed materials comprising aluminum oxide and methane, the process comprising: continuously feeding a feed stream comprising the aluminum oxide and the methane directly into a high temperature reaction zone, reacting the aluminum oxide and methane at a temperature of about 1500° C. or greater in the reaction zone to provide a continuous product stream comprising reaction products including elemental aluminum, continuously quenching the product stream, and separating the elemental aluminum from other reaction products.

13. The process of claim 12, wherein one or both of the aluminum oxide and methane are preheated before entering the reaction zone.

14. The process of claim 12, wherein the aluminum oxide and methane are rapidly heated to the temperature of about 1500° C. or greater.

15. The process of claim 14, wherein the aluminum oxide and methane are heated by a plasma arc discharge.

16. A continuous process for the production of elemental aluminum from feed materials comprising aluminum oxide and carbon monoxide, the process comprising: continuously feeding a feed stream comprising the aluminum oxide and the carbon monoxide directly into a high temperature reaction zone, reacting the aluminum oxide and carbon monoxide at a temperature of about 1500° C. or greater in the reaction zone to provide a continuous product stream comprising reaction products including elemental aluminum, continuously quenching the product stream, and separating the elemental aluminum from other reaction products.

17. The process of claim 16, wherein one or both of the aluminum oxide and carbon monoxide are preheated before entering the reaction zone.

18. The process of claim 16, wherein the aluminum oxide and carbon monoxide are rapidly heated to the temperature of about 1500° C. or greater.

19. The process of claim 18, wherein the aluminum oxide and carbon monoxide are heated by a plasma arc discharge.

20. A continuous process for the production of elemental aluminum from feed materials consisting essentially of aluminum oxide and hydrogen, the process comprising: continuously feeding a feed stream comprising the aluminum oxide and the hydrogen directly into a high temperature reaction zone, reacting the aluminum oxide and hydrogen at a temperature of about 1500° C. or greater in the reaction zone to provide a continuous product stream comprising reaction products including elemental aluminum, continuously quenching the product stream, and separating the elemental aluminum from other reaction products.

21. The process of claim 20, wherein one or both of the aluminum oxide and hydrogen are preheated before entering the reaction zone.

22. The process of claim 20, wherein the aluminum oxide and hydrogen are rapidly heated to the temperature of about 1500° C. or greater.

23. The process of claim 22, wherein the aluminum oxide and hydrogen are heated by a plasma arc discharge.

* * * * *